US007836878B1

(12) United States Patent
Agha

(10) Patent No.: US 7,836,878 B1
(45) Date of Patent: Nov. 23, 2010

(54) APPLIANCE HEAT ISOLATION SYSTEM FOR ATTACHMENT TO A VENT HOOD

(76) Inventor: Nazih S. Agha, 5852 S. 78th East Ave., Tulsa, OK (US) 74145

( * ) Notice: Subject to any disclaimer, the term of this patent is extended or adjusted under 35 U.S.C. 154(b) by 1205 days.

(21) Appl. No.: 11/429,619

(22) Filed: May 8, 2006

(51) Int. Cl.
*F24C 15/20* (2006.01)

(52) U.S. Cl. ..... 126/299 R; 126/299 C; 126/290; 126/200; 126/198

(58) Field of Classification Search ..... 126/299 R, 126/299 D, 198, 293, 302, 279, 548, 201; 454/65, 67, 56, 49, 188, 189; 55/385.2
See application file for complete search history.

(56) References Cited

U.S. PATENT DOCUMENTS

| | | | | | |
|---|---|---|---|---|---|
| 1,338,378 | A | * | 4/1920 | Larson | 126/299 D |
| 2,280,984 | A | * | 4/1942 | Thurnau | 182/51 |
| 2,715,359 | A | | 8/1955 | Mackintosh et al. | |
| 2,776,707 | A | * | 1/1957 | Helwig | 160/118 |
| 2,837,020 | A | * | 6/1958 | Gaspardo | 454/65 |
| 2,841,219 | A | * | 7/1958 | Helwig | 160/118 |
| 3,333,373 | A | * | 8/1967 | Taylor et al. | 52/63 |
| 3,359,968 | A | * | 12/1967 | Thulman | 126/550 |
| 3,875,853 | A | * | 4/1975 | Pielkenrood | 454/187 |
| 3,896,508 | A | * | 7/1975 | Doan | 4/557 |
| 3,999,911 | A | * | 12/1976 | Matsubara | 425/73 |
| 4,038,912 | A | | 8/1977 | Kuechler | |
| 4,083,395 | A | * | 4/1978 | Romano | 160/199 |
| 4,183,348 | A | * | 1/1980 | Smith | 126/545 |
| 4,355,678 | A | * | 10/1982 | Romano | 160/332 |
| 4,770,088 | A | * | 9/1988 | Kistner | 454/50 |
| 4,855,567 | A | * | 8/1989 | Mueller | 219/218 |
| 4,856,420 | A | | 8/1989 | Poblete et al. | |
| 4,961,454 | A | * | 10/1990 | Reilly et al. | 160/344 |
| 5,085,134 | A | * | 2/1992 | Hofstra et al. | 454/67 |
| D360,682 | S | | 7/1995 | Gilkison et al. | |
| 5,429,404 | A | * | 7/1995 | King, Sr. | 296/79 |
| 5,833,727 | A | * | 11/1998 | Skarsten | 55/385.2 |
| 5,967,136 | A | | 10/1999 | Gray et al. | |
| 6,302,095 | B1 | * | 10/2001 | Tolley et al. | 126/25 R |
| 6,394,171 | B1 | * | 5/2002 | Robbins, III | 160/184 |
| 6,474,983 | B1 | * | 11/2002 | Robbins | 432/64 |
| 6,672,597 | B1 | * | 1/2004 | Irrgeher et al. | 277/650 |
| 7,011,132 | B2 | * | 3/2006 | Robbins, III | 160/332 |
| 2004/0194777 | A1 | | 10/2004 | Antoniello | |
| 2009/0032011 | A1 | * | 2/2009 | Livchak et al. | 126/299 D |

FOREIGN PATENT DOCUMENTS

| | | | |
|---|---|---|---|
| EP | 404740 | A1 * | 12/1990 |

* cited by examiner

*Primary Examiner*—Steven B McAllister
*Assistant Examiner*—Desmond Peyton
(74) *Attorney, Agent, or Firm*—Crossley Patent Law; Mark A. Crossley

(57) ABSTRACT

An appliance heat isolation system for attachment to a vent hood has a mounting support with an upper mounting flange and a pair of curtain mounting rails that support the top side of a heat isolation curtain is disclosed. The curtain has front, back, right, left, top, and bottom sides. The upper mounting flange can be attached to the vent hood using screws, or chemically or mechanically adhered. There can be J-shaped channels at the ends of the inner and outer curtain mounting rails that the curtain mounting means engage. The curtain sides have flexible support members. The heat isolation curtain has an upper and lower panel of opaque washable fire resistant material and a middle panel of clear washable fire resistant material.

1 Claim, 3 Drawing Sheets

APPLIANCE HEAT ISOLATION SYSTEM FOR ATTACHMENT TO A VENT HOOD

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Many offerings exist by which the heat generated from appliances in a kitchen may be dissipated or removed. The devices offered, however, do not solve all problems associated with maintaining the heat required for the appliance to perform optimally. When too much heat is exhausted, for example, the appliance must be maintained at a higher temperature to achieve the desired result, this in turn defeats the purpose of exhausting the heat.

FIELD OF THE INVENTION

The present invention relates to an appliance heat isolation system for attachment to a vent hood for use in connection with isolation of a heated appliance from the surrounding environment. The appliance heat isolation system for attachment to a vent hood has particular utility in connection with isolating the heat from a kitchen appliance.

DESCRIPTION OF THE PRIOR ART

The use of vent hoods and other venting apparatuses is known in the prior art. For example, U.S. Pat. No. 5,967,136 to Gray et al. discloses an island countertop stove hood. However, the Gray et al. '136 patent does not provide the vent hood attachment as does the present invention, and has further drawbacks of being designed for use on a kitchen stove or range, and it not adaptable for use on a variety of kitchen appliances.

U.S. Pat. No. 4,038,912 to Kuechler discloses a combination forced-flow and convective-flow grease-hood and method having a low level entry portion over a protruding cooking appliance that functions to withdraw heat and grease from the air above an appliance. However, the Kuechler '912 patent does not have the flexible curtain system of the present invention, and additionally does not provide coverage around the entire appliance.

While the above-described devices fulfill their respective and particular objects and requirements, they do not describe an appliance heat isolation system for attachment to a vent hood that provides for the advantages of the present invention; therefore, a need exists for an improved appliance heat isolation system for attachment to a vent hood, particularly one that includes a flexible curtain system, preferably using a flexible curtain system made of fire resistant material, that is mounted to curtain support rails to isolate and contain the heat from an appliance.

In this respect, the present invention substantially departs from the conventional concepts and designs of the prior art.

SUMMARY OF THE INVENTION

In view of the foregoing disadvantages inherent in the known types of vent hoods and other venting apparatuses now present in the prior art, the present invention provides an improved appliance heat isolation system for attachment to a vent hood, and overcomes the above-mentioned disadvantages and drawbacks of the prior art. As such, the general purpose of the present invention, which will be described subsequently in greater detail, is to provide a new and improved appliance heat isolation system for attachment to a vent hood which has all the advantages of the prior art mentioned heretofore and many novel features that result in an appliance heat isolation system for attachment to a vent hood which is not anticipated, rendered obvious, suggested, or even implied by the prior art, either alone or in any combination thereof.

To attain this, the present invention essentially comprises a vent cover mounting support having an upper mounting flange and a pair of depending inner and outer curtain mounting rail. There are heat isolation curtains that are like shower curtains, and have front, back, right, left, top, and bottom sides. The top side is used to hang the curtain from the inner, outer or both mounting rails through a mounting means. The upper mounting flange has a plurality of connector ports, or holes, for the screws used to mount the vent cover mounting support to the vent hood. The screws are sized to fit within and engage with the connector ports. The upper mounting flange can be chemically glued or mechanically adhered to the vent hood, through welding at the factory or in the kitchen as in a retrofitting using a portable welder. There can be inwardly facing J-shaped channels at the end of the inner and outer curtain mounting rail, and the curtain mounting means would be adapted to engage the J-shaped channels. The curtain mounting means can be hooks, hooks on rollers, or T-shaped attachment apparatus. The heat isolation curtain has flexible support members on the right, left, and bottom sides, that serve to stiffen the curtain. The heat isolation curtain is formed from fire resistant materials to both reduce the possibility of a kitchen fire, and to utilize the increased heat resistance from this material. There has thus been outlined, rather broadly, the more important features of the invention in order that the detailed description thereof that follows may be better understood and in order that the present contribution to the art may be better appreciated.

The invention may also include a heat isolation curtain that has an upper panel of opaque washable fire resistant material, a middle panel of clear washable fire resistant material, and a lower panel of opaque washable fire resistant material. The mixture of opaque and clear sections would allow the appliance to be visible during use, and could allow for monitoring for such events as fires or flare-ups. There are, of course, additional features of the invention that will be described hereinafter and which will form the subject matter of the claims attached.

It is therefore an object of the present invention to provide a new and improved appliance heat isolation system for attachment to a vent hood that has all of the advantages of the prior art vent hoods and other venting apparatuses and none of the disadvantages.

It is another object of the present invention to provide a new and improved appliance heat isolation system for attachment to a vent hood that may be easily and efficiently manufactured and marketed.

An even further object of the present invention is to provide a new and improved appliance heat isolation system for attachment to a vent hood that has a low cost of manufacture with regard to both materials and labor, and which accordingly is then susceptible to low prices of sale to the consuming public, thereby making such appliance heat isolation system for attachment to a vent hood economically available to the buying public.

Still another object of the present invention is to provide a new appliance heat isolation system for attachment to a vent hood that provides in the apparatuses and methods of the prior art some of the advantages thereof, while simultaneously overcoming some of the disadvantages normally associated therewith.

Even still another object of the present invention is to provide an appliance heat isolation system for attachment to a vent hood for isolating the appliance contained within the curtain from the surrounding area. This reduces the heat load to the air conditioning unit in the kitchen, and thus saves energy.

Still yet another object of the present invention is to provide an appliance heat isolation system for attachment to a vent hood for retaining the heat within the area surrounding a kitchen appliance. This makes it possible to use less energy to heat the appliance, as the operating temperature is more closely maintained as heat is not escaping to other areas of the kitchen.

Lastly, it is an object of the present invention to provide a new and improved appliance heat isolation system for attachment to a vent hood for reducing the possibility of a kitchen fire spreading from an appliance, as the curtain is formed from a fire resistant material, and thereby contains heat and smoke from the fire.

Thus has been broadly outlined the more important features of the appliance heat isolation system for attachment to a vent hood so that the detailed description thereof that follows may be better understood and in order that the present contribution to the art may be better appreciated.

Numerous objects, features and advantages of the appliance heat isolation system for attachment to a vent hood will be readily apparent to those of ordinary skill in the art upon reading the following detailed description of presently preferred, but nonetheless illustrative, embodiments of the appliance heat isolation system for attachment to a vent hood when taken in conjunction with the accompanying drawings. In this respect, before explaining the current embodiments of the appliance heat isolation system for attachment to a vent hood in detail, it is to be understood that the invention is not limited in its application to the details of construction and arrangements of the components set forth in the following description or illustration. The invention is capable of other embodiments and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the appliance heat isolation system for attachment to a vent hood. It is therefore important that the claims be regarded as including such equivalent constructions insofar as they do not depart from the spirit and scope of the present invention.

These together with additional objects of the appliance heat isolation system for attachment to a vent hood, along with various novel features that characterize the invention are particularly pointed out in the claims forming a part of this disclosure. For better understanding of the appliance heat isolation system for attachment to a vent hood, its operating advantages and specific objects attained by its uses, refer to the accompanying drawings and description.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numbers refer to the same parts throughout the various figures.

DETAILED DESCRIPTION OF THE PREFERRED EMBODIMENT

Figure 1:
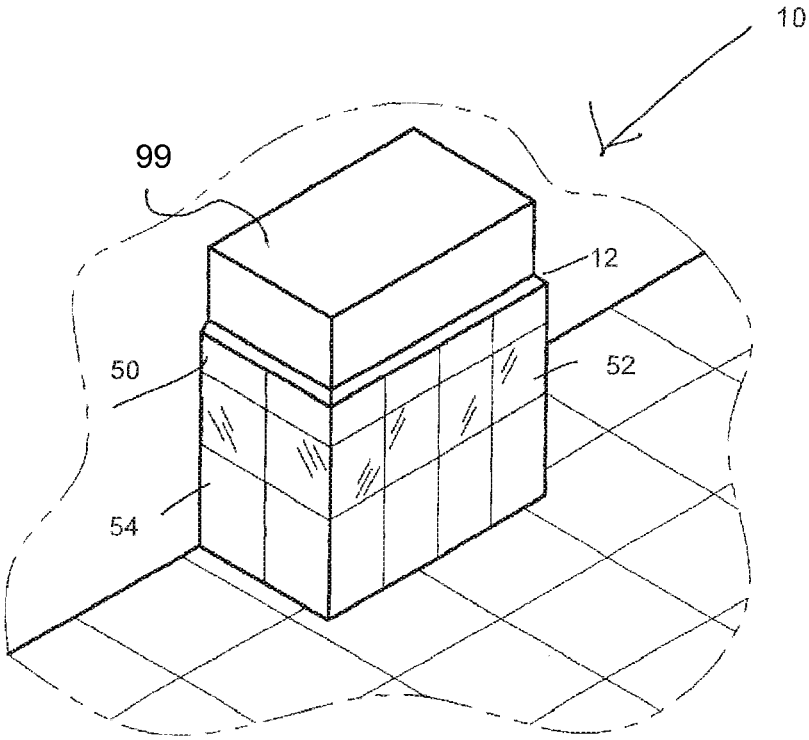
FIG. 1 is a perspective view of the preferred embodiment of the appliance heat isolation system for attachment to a vent hood constructed in accordance with the principles of the present invention.

Referring now to the drawings, and particularly to FIGS. 1-6, a preferred embodiment of the appliance heat isolation system for attachment to a vent hood of the present invention is shown and generally designated by the reference numeral 10.

In FIG. 1, a new and improved appliance heat isolation system for attachment to a vent hood 10 of the present invention for isolating the heat produced from kitchen appliances is illustrated and will be described. The device is shown in use in a kitchen. More particularly, the appliance heat isolation system for attachment to a vent hood 10 has a vent cover mounting support 12 having an upper mounting flange 14 and an inner curtain mounting rail 16 and an outer curtain mounting rail 18. The heat isolation curtain 20 ahs a front side 22, a back side 24, a right side 26, a left side 28, a top side 30 and a bottom side 32. The top side 30 has a curtain mounting means 24. The upper mounting flange 14 has a plurality of connector ports 36 to interact with a plurality of screws 38, but the upper mounting flange 14 can be attached to the vent hood 99 through chemical or mechanical adhesion.

Figure 2:
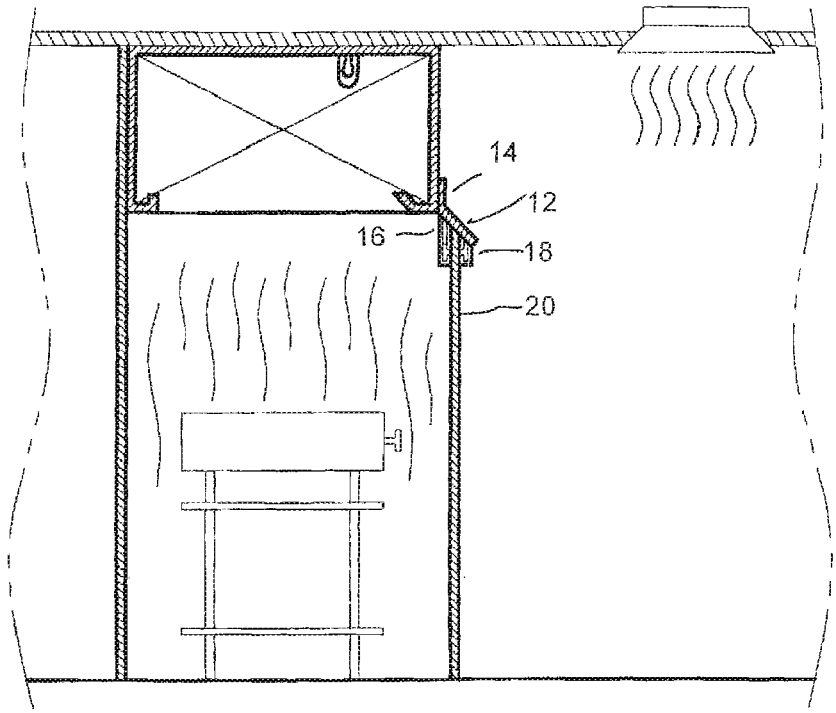
FIG. 2 is a cross sectional view of the appliance heat isolation system for attachment to a vent hood, showing the system in use.

FIG. 2 is a cross sectional view of the appliance heat isolation system for attachment to a vent hood, showing the system in use isolating a kitchen appliance, and the heat containment of the appliance from the facility's air conditioning is shown. The vent cover mounting support 12 has an upper mounting flange 14 and an inner curtain mounting rail 16 and an outer curtain mounting rail 18. The heat isolation curtain 20 has a front side 22, a back side 24, a right side 26, a left side 28, a top side 30 and a bottom side 32. The top side 30 has a curtain mounting means 34. The upper mounting flange 14 has a plurality of connector ports 36 or holes, and there are a plurality of screws 38 sized to interact with the connector ports 36. The upper mounting flange 14 can also be chemically or mechanically adhered to the vent hood. There can be inwardly facing J-shaped channels 40 at the end of the inner curtain mounting rail 16 and an inwardly facing J-shaped channel 42 at the end of the outer curtain mounting rail 18. The heat isolation curtain mounting means 34 are adapted to engage the inwardly facing J-shaped channels 40 and 42.

Figure 3:
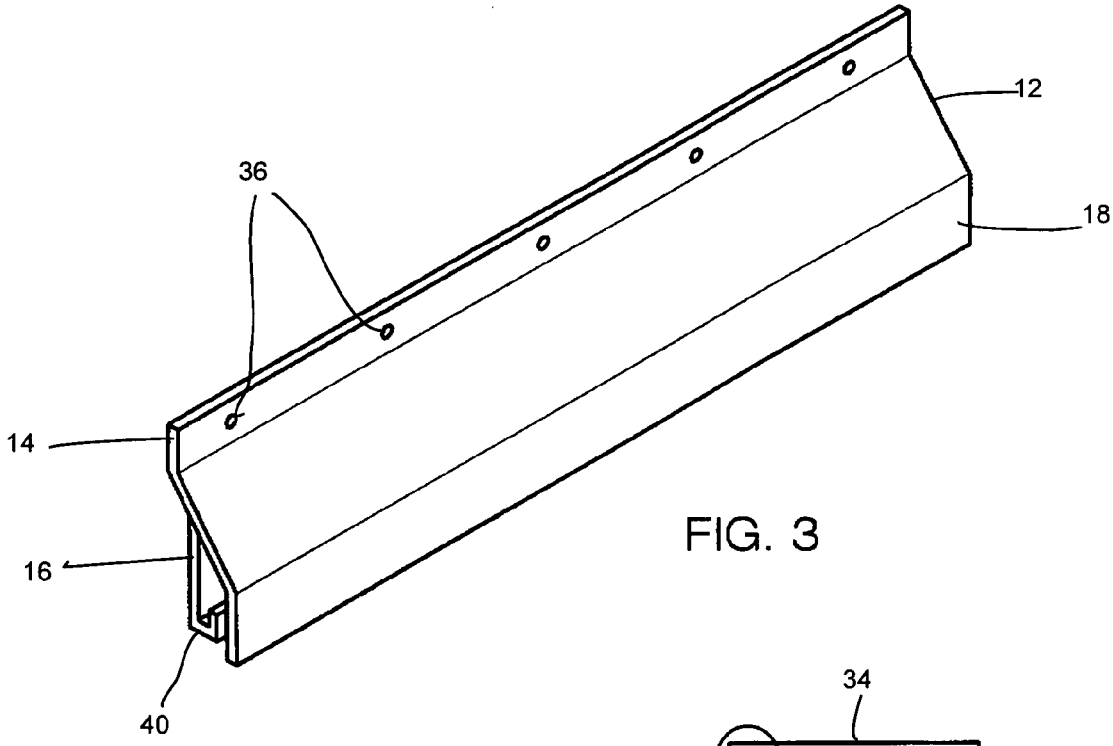
FIG. 3 is a perspective view of the vent cover mounting rail of the appliance heat isolation system for attachment to a vent hood.

FIG. 3 is a perspective view of the vent cover mounting rail of the appliance heat isolation system for attachment to a vent hood. The vent cover mounting support 12 has an upper mounting flange 14, an inner curtain mounting rail 16 and an outer curtain mounting rail 18. The upper mounting flange 14 has a plurality of connector ports 36 or holes, and there are a plurality of screws 38 sized to interact with the connector ports 36. The upper mounting flange 14 can also be chemically or mechanically adhered to the vent hood. There can be inwardly facing J-shaped channels 40 at the end of the inner curtain mounting rail 16 and an inwardly facing J-shaped channel 42 at the end of the outer curtain mounting rail 18.

Figure 4:
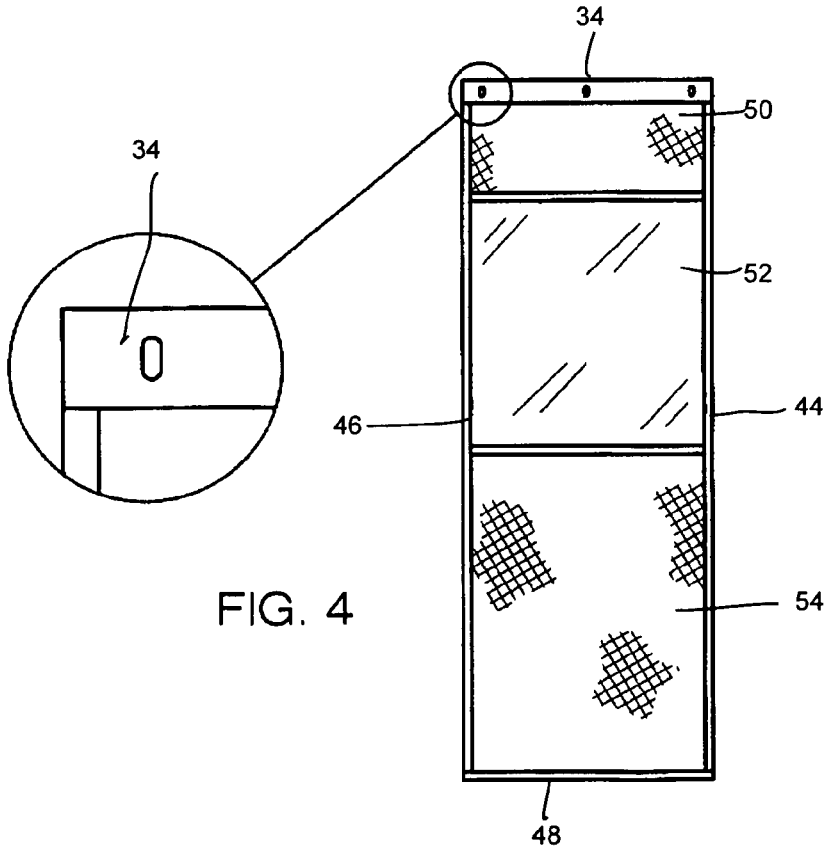
FIG. 4 is a front view of the fire resistant curtain mounted in the vent cover mounting rail of the appliance heat isolation system for attachment to a vent hood, including a close-up detail view of one method of mounting the vent cover mounting rail.

FIG. 4 is a front view of the fire resistant curtain mounted in the vent cover mounting rail of the appliance heat isolation system for attachment to a vent hood, including a close-up detail view of one method of mounting the heat isolation curtain 20, wherein hooks could be used, by placing one side of the hook inside the hole in the curtain and looping the other side of the hook inside the J-shaped channel. The heat isolation curtain 20 has a right side flexible support member 44, left side flexible support member 46, and bottom side flexible support member 48. The heat isolation curtain 20 is preferably formed from fire resistant materials. The heat isolation curtain can have an upper panel 50 of opaque washable fire resistant material, a middle panel 52 of clear washable fire resistant material, and a lower panel 54 of opaque washable fire resistant material.

Figure 5:
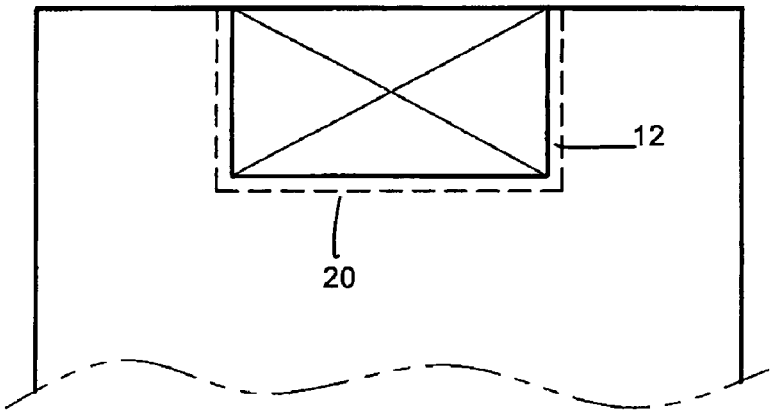
FIG. 5 is a top view of the appliance heat isolation system for attachment to a vent hood, showing one installation type possible with the system.

FIG. 5 is a top view of the appliance heat isolation system for attachment to a vent hood, showing one installation type possible with the system.

Figure 6:
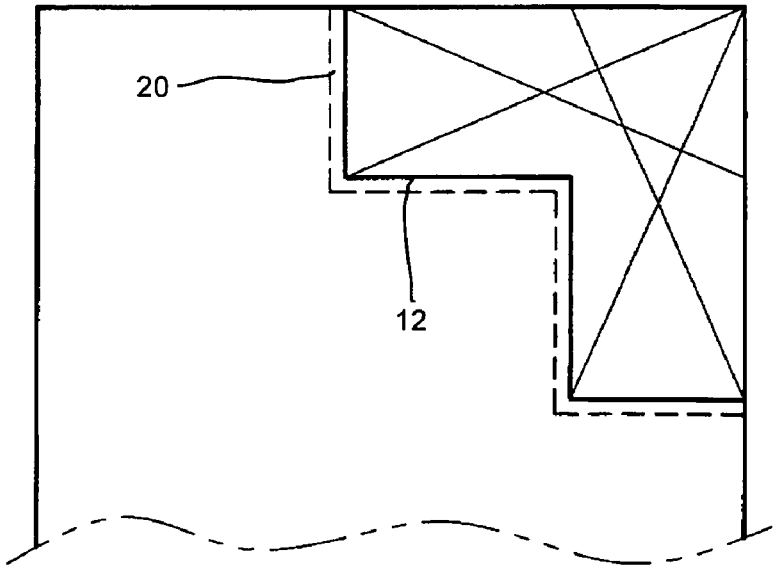
FIG. 6 is a top view of the appliance heat isolation system for attachment to a vent hood, showing an additional installation type possible with the system.

FIG. 6 is a top view of the appliance heat isolation system for attachment to a vent hood, showing an additional installation type possible with the system.

The vent cover mounting support has an upper mounting flange, an inner curtain mounting rail and an outer curtain mounting rail. The heat isolation curtain has front, back, right, left, top and bottom sides. The top side has a curtain mounting means. The upper mounting flange has a plurality of connector ports or holes, and a plurality of screws sized to interact with the connector ports. The upper mounting flange can also be chemically or mechanically adhered to the vent hood. There can be inwardly facing J-shaped channels at the end of the inner curtain mounting rail and an inwardly facing J-shaped channel at the end of the outer curtain mounting rail. The heat isolation curtain mounting means are adapted to engage the inwardly facing J-shaped channels. The heat isolation curtain has a right side flexible support member, left side flexible support member, and bottom side flexible support member. The heat isolation curtain is preferably formed from fire resistant materials, and can have a closure means such as magnetic strips or hook and loop fabric to ensure a tight fit. The heat isolation curtain can have an upper panel of opaque washable fire resistant material, a middle panel of clear washable fire resistant material, and a lower panel of opaque washable fire resistant material.

In use, it can now be understood that the upper mounting flange of the vent cover mounting support is attached to the vent hood through screws, welding or chemical glue. The vent cover mounting support has an angled front that separates the two channels that can hold the heat isolation curtain. The heat isolation curtain is held in the J-shaped channels through connector means that are adapted to engage the channels and allow the curtain to slide freely.

While a preferred embodiment of the appliance heat isolation system for attachment to a vent hood has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable attachment method may be used instead of the methods described. And although use in a kitchen has been described, it should be appreciated that the appliance heat isolation system for attachment to a vent hood herein described is also suitable for isolating the heat emitted from a wide variety of sources, and is capable of utilization in a variety of environments.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An appliance heat isolation system comprising a vent cover mounting support having an upper mounting flange and a pair of depending inner and outer curtain mounting rails;

a heat isolation curtain having a front side, a back side, a right side, a left side, and top side, and a bottom side, said top side having a mounting means;

wherein said upper mounting flange has a plurality of connector ports, said connector ports having opposite first and second ends and being defined by a port-confining wall and further comprising a plurality of screws sized to interact with said connector ports;

wherein said upper mounting flange is selectively alternately chemically and mechanically adhered to the vent hood;

an inwardly facing J-shaped channel at the terminus of said inner curtain mounting rail and an inwardly facing J-shaped channel at the terminus of said outer curtain mounting rail;

wherein said heat isolation curtain mounting means are adapted to engage said inwardly facing J-shaped channels;

wherein said heat isolation curtain has flexible support members on said right, left, and bottom sides;

wherein said heat isolation curtain has an upper panel of opaque washable fire resistant material, a middle panel of clear washable fire resistant material, and a lower panel of opaque washable fire resistant material.

* * * * *